US007921926B2

(12) United States Patent
Drenth et al.

(10) Patent No.: US 7,921,926 B2
(45) Date of Patent: Apr. 12, 2011

(54) JOINTED SPEARHEAD ASSEMBLY

(75) Inventors: Christopher L. Drenth, Draper, UT (US); George Ibrahim, Mississauga (CA); Anthony Lachance, North Bay (CA)

(73) Assignee: Longyear TM, Inc., South Jordan, UT (US)

( * ) Notice: Subject to any disclaimer, the term of this patent is extended or adjusted under 35 U.S.C. 154(b) by 108 days.

(21) Appl. No.: 12/349,431

(22) Filed: Jan. 6, 2009

(65) Prior Publication Data

US 2009/0283327 A1 Nov. 19, 2009

Related U.S. Application Data

(60) Provisional application No. 61/053,953, filed on May 16, 2008.

(51) Int. Cl.
*E21B 19/00* (2006.01)
*E21B 23/00* (2006.01)
*E21B 31/00* (2006.01)

(52) U.S. Cl. ..... 166/385; 166/237; 294/86.13

(58) Field of Classification Search ..... 166/241.5, 166/385, 237, 98, 99, 301; 175/94; 294/86.13
See application file for complete search history.

(56) References Cited

U.S. PATENT DOCUMENTS

| | | | | |
|---|---|---|---|---|
| 311,157 | A | | 1/1885 | Wheeler |
| 2,333,802 | A | | 11/1943 | Lowrey |
| 2,347,726 | A | | 5/1944 | Auld et al. |
| 2,705,167 | A | | 3/1955 | Layne et al. |
| 2,885,182 | A | * | 5/1959 | Hering ..... 175/80 |
| 2,905,438 | A | | 9/1959 | Church |
| 2,918,323 | A | | 12/1959 | Coffee |
| 3,103,981 | A | | 9/1963 | Harper |
| 3,127,943 | A | | 4/1964 | Mori |
| 3,173,719 | A | | 3/1965 | Ringler |
| 3,266,835 | A | | 8/1966 | Hall et al. |
| 3,305,033 | A | | 2/1967 | Pickard et al. |
| 3,333,647 | A | | 8/1967 | Karich et al. |
| 3,340,939 | A | | 9/1967 | Lindelof |
| 3,346,059 | A | | 10/1967 | Svendsen |
| 3,373,826 | A | | 3/1968 | Ingram |
| 3,461,981 | A | | 8/1969 | Casper et al. |
| 3,990,524 | A | | 11/1976 | Sweeney |
| 4,281,725 | A | | 8/1981 | Runk |

(Continued)

FOREIGN PATENT DOCUMENTS

| | | |
|---|---|---|
| WO | WO 97/08379 | 3/1997 |

(Continued)

OTHER PUBLICATIONS

International Search Report and Written Opinion dated Dec. 22, 2009 as issued in International Application No. PCT/US2009/044147 filed May 15, 2009.

(Continued)

*Primary Examiner* — Kenneth Thompson
*Assistant Examiner* — Catherine Loikith
(74) *Attorney, Agent, or Firm* — Workman Nydegger

(57) ABSTRACT

A jointed spearhead assembly can include a base portion that is adapted to be connected to a down-hole object and a spearhead portion having a first end and a second. The second end includes a follower tab with a non-convex first follower interface. The spearhead portion can be pivotally coupled to the base portion.

27 Claims, 6 Drawing Sheets

U.S. PATENT DOCUMENTS

| | | | | |
|---|---|---|---|---|
| 4,591,197 | A | 5/1986 | Akkerman | |
| 4,800,969 | A | 1/1989 | Thompson | |
| 4,944,543 | A | 7/1990 | Walsh | |
| 5,020,612 | A | 6/1991 | Williams | |
| 5,201,814 | A | 4/1993 | Kitchell et al. | |
| 5,267,620 | A | 12/1993 | Lee | |
| 5,325,930 | A | 7/1994 | Harrison | |
| 5,339,915 | A | 8/1994 | Laporte et al. | |
| 5,392,851 | A | 2/1995 | Arend | |
| D399,462 | S | 10/1998 | Toffolo et al. | |
| D413,126 | S | 8/1999 | Warren et al. | |
| 5,934,393 | A | 8/1999 | Marshall | |
| 5,992,543 | A | 11/1999 | Soinski et al. | |
| 6,019,181 | A | 2/2000 | Soinski et al. | |
| 6,029,758 | A | 2/2000 | Novacovicci et al. | |
| 6,045,171 | A | 4/2000 | McLeod et al. | |
| 6,059,053 | A | 5/2000 | McLeod | |
| 6,089,335 | A | 7/2000 | Able | |
| 6,109,373 | A | 8/2000 | Able | |
| D434,707 | S | 12/2000 | Bauer | |
| 6,425,449 | B1 | 7/2002 | Marshall | |
| D468,753 | S | 1/2003 | Fergusson | |
| D471,211 | S | 3/2003 | Sollami | |
| 7,296,638 | B2 | 11/2007 | Beach et al. | |
| D563,287 | S | 3/2008 | Falter et al. | |
| 7,383,899 | B2 * | 6/2008 | Beach et al. | 175/246 |
| D581,952 | S | 12/2008 | Hall et al. | |
| 7,584,055 | B2 | 9/2009 | Parfitt | |
| 2005/0034894 | A1 | 2/2005 | Beach et al. | |
| 2005/0269138 | A1 | 12/2005 | Beach | |
| 2007/0046051 | A1 | 3/2007 | Streater, Jr. et al. | |
| 2009/0206620 | A1 | 8/2009 | McLeod et al. | |
| 2009/0229884 | A1 | 9/2009 | Pardey | |
| 2009/0260882 | A1 | 10/2009 | Drenth | |
| 2009/0283329 | A1 * | 11/2009 | Able et al. | 175/246 |
| 2010/0012383 | A1 | 1/2010 | Drenth | |

FOREIGN PATENT DOCUMENTS

| | | | |
|---|---|---|---|
| WO | 2004-018831 | A1 | 3/2004 |
| WO | 2006-128235 | A1 | 12/2006 |
| WO | 2010/096860 | A1 | 9/2010 |

OTHER PUBLICATIONS

Notice of Allowance dated Feb. 5, 2010 from U.S. Appl. No. 29/352,055, filed Dec. 15, 2009 (13 pages).

Office Action dated Feb. 18, 2010 from U.S. Appl. No. 29/352,115, filed Dec. 16, 2009 (9 pages).

Notice of Allowance dated Feb. 22, 2010 from U.S. Appl. No. 29/352,049, filed Dec. 15, 2009 (14 pages).

Office Action dated Feb. 18, 2010 from U.S. Appl. No. 29/352,117, filed Dec. 16, 2009 (10 pages).

Notice of Allowance dated Apr. 28, 2010 from U.S. Appl. No. 29/352,115, filed Dec. 16, 2009 (6 pages).

Notice of Allowance dated Apr. 29, 2010 from U.S. Appl. No. 29/352,055, filed Dec. 15, 2009 (15 pages).

Notice of Allowance dated May 10, 2010 from U.S. Appl. No. 29/352,049, filed Dec. 15, 2009 (18 pages).

Notice of Allowance dated May 18, 2010 from U.S. Appl. No. 29/352,117, filed Dec. 16, 2009 (6 pages).

Issue Notification dated Aug. 11, 2010 from U.S. Appl. No. 29/352,115 filed Dec. 15, 2009 (1 page).

Issue Notification dated Sep. 8, 2010 from U.S. Appl. No. 29/352,049 filed Dec. 15, 2009 (1 page).

* cited by examiner

JOINTED SPEARHEAD ASSEMBLY

CROSS-REFERENCE TO RELATED APPLICATIONS

This application claims the benefit of U.S. Patent Application 61/053,953 filed May 16, 2008, the entirety of which is hereby incorporated-by reference.

BACKGROUND OF THE INVENTION

1. The Field of the Invention

This application relates generally to a spearhead assembly that is used for in-ground drilling.

2. The Relevant Technology

In some processes of down-hole drilling, a wireline and hoist may be used to lower and retrieve various tools or other down-hole objects in and out of the borehole. For example, a wireline may be connected to an overshot assembly and then used to lower or retrieve a spearhead assembly that is connected to a core barrel assembly. When retrieving such assemblies, the wireline and hoist often elevate the core barrel assemblies until they are completely extracted from the borehole. At that point, the lower end of the core barrel assembly may be moved away from the borehole and then lowered so as to lay flat on the surface of the earth. As the coupled overshot, spearhead, and core barrel assemblies are lowered, very high loads can be placed on various parts and cause bending or breaking of those parts.

In order to reduce the danger and damage associated with moving the coupled assemblies, some drilling processes have begun using jointed spearheads that contain a spearhead portion that is pivotally connected to a base portion. Because of the pivotal connection, the stress from the loads may be reduced. But the spearhead portion may also pivot from side to side and become locked against an internal surface of the borehole (or a drill string in the borehole) where it cannot be coupled with an overshot assembly for retrieval.

To avoid such problems, the spearhead portion of some jointed spearheads may be biased to a position that is convenient for coupling with the overshot. For example, some jointed spearheads may comprise a spring that biases the spearhead portion to one or more positions in relation to the base portion. Nevertheless, the design of some jointed spearheads may impose various limitations, i.e., causing the spearhead to be weak near the pivot joint. Accordingly, when such joints are misused or overloaded, deformation, accidental uncoupling, or failure may occur.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY OF THE INVENTION

A jointed spearhead assembly can include a base portion that is adapted to be connected to a down-hole object and a spearhead portion having a first end and a second. The second end includes a follower tab with a non-convex first follower interface. The spearhead portion being pivotally coupled to the base portion.

A jointed spearhead assembly can include a base portion containing a recess that opens into a slot defined by a plurality of arms, wherein a follower and a bias portion are at least partially disposed within the recess, and a spearhead portion comprising a overshot connector and a follower tab. The follower tab includes a first follower interface that is substantially flat and disposed at a first end and the follower tab is pivotally connected between the plurality of arms of the base portion, and wherein the follower contacts the first follower interface to provide the spearhead portion with a detent position.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

Figures 1A, 1B:
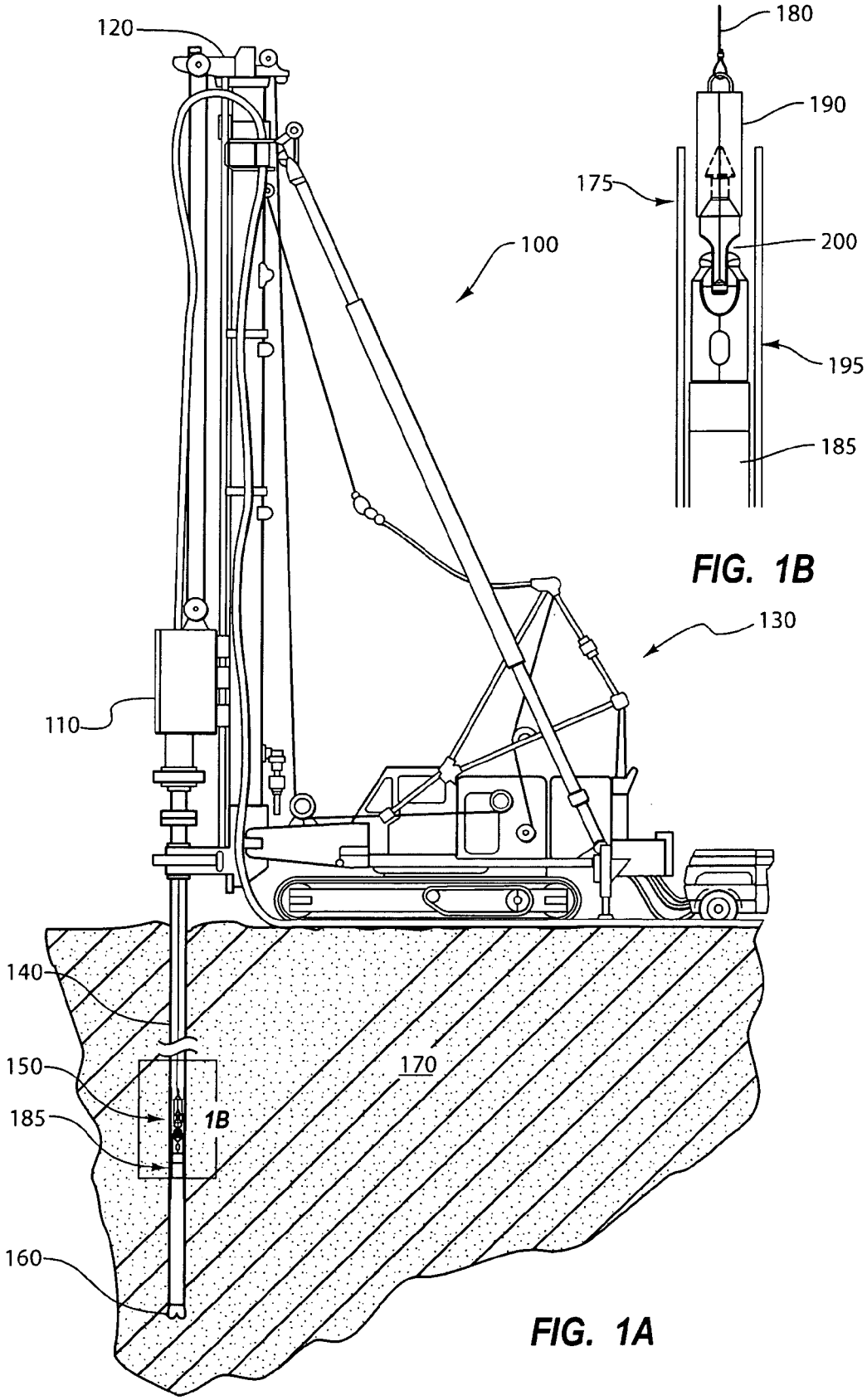
FIG. 1A illustrates a drilling system having a jointed spearhead assembly according to one example.
FIG. 1B illustrates a partial view of the drilling system of FIG. 1A.

Together with the following description, the Figures may help demonstrate and explain the principles of jointed spearhead assemblies and its associated methods of manufacture and use of the spearhead assemblies. In the Figures, the thickness and configuration of portions may be exaggerated for clarity. The same reference numerals in different Figures represent the same portion.

DETAILED DESCRIPTION OF THE PREFERRED EMBODIMENTS

A spearhead assembly, methods, and systems are provided herein. The spearhead assembly can include a spearhead portion and a base portion. The spearhead portion can have a follower tab having a non-convex first follower interface. A follower and biasing member can be associated with the base portion, such as being positioned at least partially within the base portion.

Such a configuration can allow the spearhead assembly to pivot to assist in shifting mechanical stresses and strains from the weakest points to areas of greater strength and durability. Further, since the biasing member may be housed within a recess within the base portion, safety can be increased because operators may not be pinched or otherwise injured by an exposed spring of the biasing member. In addition, the biasing member may be located outside the follower and within the base portion, as opposed to being located within the follower tab. Such a configuration can allow the biasing member to be larger and stronger than conventional springs.

Additionally, the strength of the spearhead assembly at the pivot joint between the spearhead portion and the base portion can be increased. For example, support arms may be disposed on the base portion instead of on the spearhead portion. Also, the follower may be disposed in the base portion instead of in the spearhead portion. This configuration allows the support arms to have larger cross-sectional areas than some conventional jointed spearhead assemblies. Thus, the arms of the spearhead assembly may be stronger than those of conventional jointed spearhead assemblies. Accordingly, the spearhead assembly 200 may be less prone to bending, deformation, undesired uncoupling, and/or failure that may occur in attempts to pivot the spearhead in a plane other than that intended.

The following description supplies specific details in order to provide a thorough understanding. Nevertheless, the skilled artisan would understand the apparatus and associated methods of making and using the apparatus can be implemented and used without employing these specific details. Indeed, the apparatus and associated methods can be used in conjunction with any apparatus, system, portions, and/or technique conventionally used in the industry. For example, while the description below focuses on using the jointed spearhead assembly for coupling a core barrel assembly to a wireline via an overshot assembly, the knuckle joint spearhead assembly may be used to connect tools or other down-hole objects to a wireline.

FIGS. 1A and 1B illustrate a drilling system 100 that includes a drill head 110. The drill head 110 can be coupled to a mast 120 that in turn is coupled to a drill rig 130. The drill rig 130 is configured to move and/or position the drilling system 100 to a desired location. The mast in turn is configured to support and orient the drill head 110. The drill head 110 is configured to have an outer casing 140 coupled thereto. The outer casing 140 can in turn be coupled to additional drill rods to form an outer drill string 150. In turn, the last outer casing of the drill string 150 can be coupled to a drill bit 160 configured to interface with the material to be drilled, such as a formation 170.

In at least one example, the drill head 110 illustrated in FIGS. 1A and 1B is configured to rotate the drill string 150 during a drilling process. In particular, the rotational rate of the drill string can be varied as desired during the drilling process. Further, the drill head 110 can be configured to translate relative to the mast 120 to apply an axial force to the drill head 110 to urge the drill bit 160 into the formation during a drilling process. The drilling system 100 also includes a wireline assembly 175 positioned within the drill string 150. The wireline assembly 175 can include a wireline 180, a down-hole component 185, an overshot assembly 190, and a head assembly 195 having a jointed spearhead assembly 200. In the illustrated example, the down-hole component 185 can include a core-lifter assembly configured to grasp a core sample as the drill head 110 urges the drill bit 160 out of the formation 170 and then contain the core sample as the wireline 180 is used to retrieve the core sample.

In particular, the down-hole component 185 can be coupled to the head assembly, which in turn can be removably coupled to the overshot assembly 190 by way of the jointed spearhead assembly 200. When thus assembled, the wireline 180 can be used to lower the down-hole component 185, the overshot assembly 190, and the head assembly 195, into position within the drill string 150. When the assembly reaches the desired location, a mechanism in the head assembly 195 can be deployed to lock the head assembly 195 into position relative to the drill string 150. The overshot assembly 190 can also be actuated to disengage the head assembly 195 and to disengage the spearhead assembly 200 in particular. Thereafter, the down-component portion 185 can rotate with the drill string 150 due to the coupling of the down-hole portion 185 to the head assembly 195 and of the head assembly 195 to the drill string 150.

At some point it may be desirable to trip the down-hole component 185 to the surface, such as to retrieve a core sample. To retrieve the down-hole component 185, the wireline 180 can be used to lower the overshot assembly 190 into engagement with the head assembly 195 and the spearhead assembly 200 in particular. The head assembly 195 may then be disengaged from the drill string 150. Thereafter, the overshot assembly 190, the head assembly 195, and the down-hole component 185 can be tripped to the surface. As will be discussed in more detail below, the spearhead assembly 200 can have a robust configuration that reduces stresses associated with movement of the head assembly 195 relative to the drill string 150 by allowing a spearhead to pivot relative to a base portion. Further, the spearhead assembly 200 can return to a neutral position by interaction between a follower and a non-convex first follower surface on the spearhead assembly.

Figure 2A:
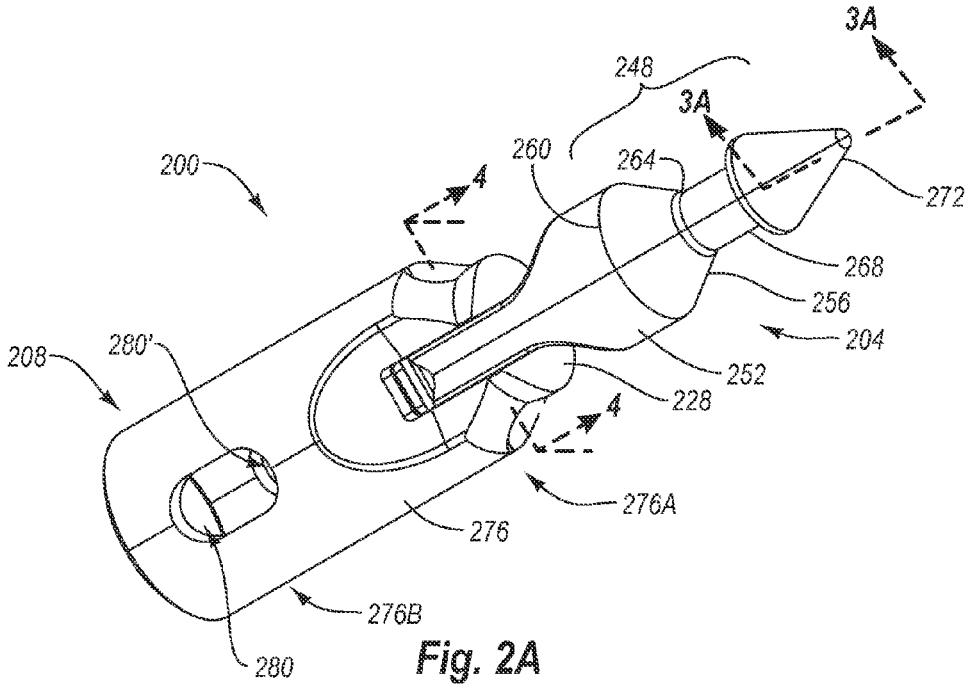
FIG. 2A illustrates a perspective view of a spearhead assembly according to one example.
Figure 2B:
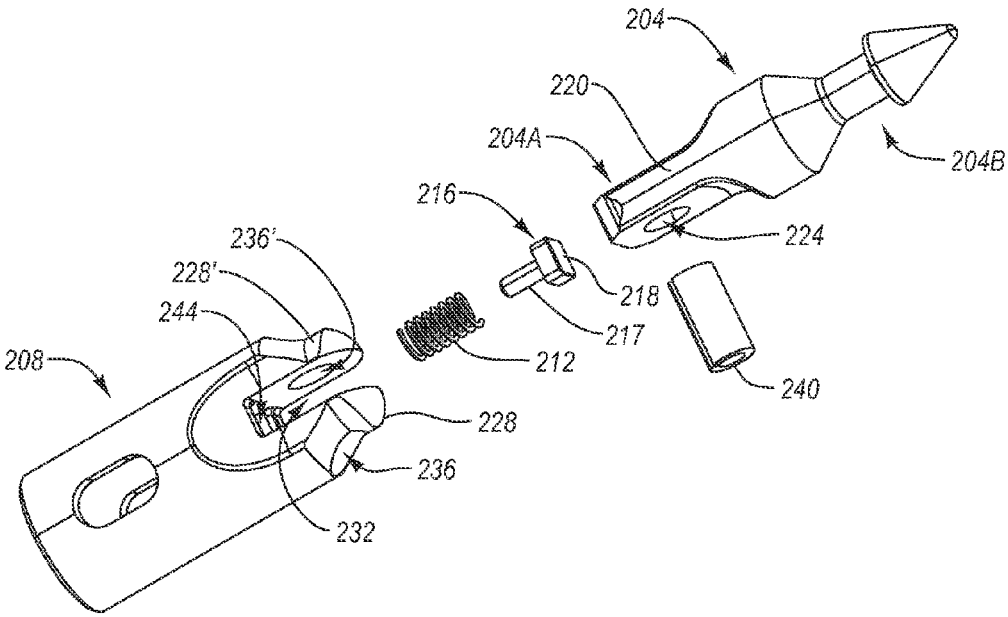
FIG. 2B illustrates an exploded view of the spearhead assembly illustrated in FIG. 2A.

As shown in FIG. 2A and FIG. 2B, the spearhead assembly 200 can generally include a spearhead portion 204, a base portion 208, a biasing member 212 and a follower 216. As illustrated in FIG. 2B, the follower 216 may comprise a shaft 217 and a contact surface 218. The width of the contact surface 218 may be larger than the diameter of the shaft 217. Thus, the contact surface 218 may form a lip or overhang near the top of the shaft 217, against which the biasing member 212 may exert pressure.

The biasing member 212 and/or the follower 216 may be positioned at least partially within the spearhead portion 204 or the base portion 208. For ease of reference, the biasing member 212 and the follower 216 will be discussed as being positioned within the base portion 208. The base portion 208 may be adapted to connect to any known down-hole object, such as a conventional core barrel inner tube assembly (not shown). The spearhead portion 204 may include any feature that allows it to be pivotally connected to the base portion 208.

The spearhead portion 204 can be further configured to engage an overshot assembly to allow the spearhead assembly to be raised or lowered by a wireline. The biasing member 212 and follower 216 can exert a biasing force on the spearhead portion 204 to urge the spearhead portion 204 to a center-neutral position while allowing the spearhead portion 204 to pivot relative to base portion 208. Allowing the spearhead portion 204 to pivot can reduce the dangers and costs associated with moving an overshot that is coupled to an inner tube assembly.

The configuration of the spearhead portion 204 will first be introduced, followed by an introduction of the base portion 208. Thereafter, the interaction between the spearhead portion 204 and the base portion 208 will be introduced followed by a discussion of the interaction between the follower 216 and the spearhead portion 204. In the illustrated example, the spearhead portion 204 includes a first end 204A and a second end 204B. The first end 204A can be configured to engage an overshot assembly. The second end 204B includes a follower tab 220 configured to engage the follower 216. The spearhead portion 204 further includes a pivot hole 224 defined therein.

The base portion 208 can include support arms 228, 228' that are spaced apart to define a slot 232. The slot 232 can be sized to allow the follower tab 220 to be received therein. The support arms 228, 228' can further include pivot holes 236, 236' defined therein. The spearhead assembly 200 can further include a pin 240. The spearhead portion 204 can be positioned relative to the base portion 208 in such a manner that the pivot hole 224 in the spearhead portion 204 is aligned relative to the pivot holes 236, 236' in the support arms 228, 228'. The pin 240 can then be passed through the pivot holes 224, 236, 236' to pivotingly couple the spearhead portion 204 to the base portion 208.

Accordingly, the spearhead portion 204 may be pivotally connected to the base portion 208. In at least one example, interior surfaces of the support arms 228, 228' and the exterior surfaces of the follower tab 220 can be generally parallel. Such a configuration can allow the spearhead portion 204 to have a range of motion substantially in a single plane. For example, the spearhead portion 204 may pivot about 90 degrees in opposite directions from a center-neutral position, otherwise referred to as a 0 degree position. However, in another example, the spearhead portion 204 may be able to pivot more or less than 90 degrees in opposite directions from the center-neutral position. For instance, the spearhead portion 204 may be able to pivot as little as 5 degrees or as much as 170 degrees (in opposite directions from the center-neutral position).

As illustrated in FIG. 2B, a recess 244 can be defined in the base portion 208. In at least one example, the recess 244 can be in communication with the slot 232. The recess 244 can be configured to receive the biasing member 212 and/or the follower 216 therein.

The recess 244 may have any characteristic that allows it to receive the follower 216 and/or the biasing member 212, as described below. For example, the recess 244 may be any shape, including, but not limited to, cylindrical, cuboidal, polygonal, and combinations thereof. The recess 244 may also be closed at one end or otherwise have a surface that may contact, and oppose force from, the base portion 208. While positioned within the base portion 212, the biasing member 212 can exert a biasing force on the follower 216 to urge the follower into engagement with the follower tab 220. The engagement between the follower 216 and the follower tab 220 can allow the spearhead assembly to pivot to assist in shifting mechanical stresses and strains from the weakest points to areas of greater strength and durability. Further, since the biasing member may be housed within a recess within the base portion, safety can be increased because operators may not be pinched or otherwise injured by an exposed spring of the biasing member. In addition, the biasing member may be located outside the follower and within the base portion, as opposed to being located within the follower tab, the biasing member may be larger and stronger than conventional springs.

As also illustrated in FIG. 2A and FIG. 2B, the spearhead portion 204 may include an overshot coupling portion 248 and a cylindrical body portion 252. The cylindrical body portion 252 may serve many purposes. For example, the cylindrical body portion 252 may serve to strengthen the spearhead portion 204 and to reduce its deformation. Moreover, the cylindrical body portion 252 may have any feature that permits it to interconnect the overshot coupling portion 248 and follower tab 220. For example, the cylindrical body portion 252 may be any shape, including, but not limited to cylindrical, cuboidal, rectangular, polygonal, or other shapes and/or combinations thereof. The cylindrical body portion 252 may have any suitable diameter for use in any drilling operation.

The overshot coupling portion 248 allows the spearhead assembly 200 to be selectively coupled to an overshot or other similar apparatus. Thus, the overshot coupling portion 248 may have any feature that allows it to be selectively coupled to any known overshot assembly. For instance, FIG. 2A and FIG. 2B show that the overshot coupling portion 248 may comprise a frustoconical portion 256. The frustoconical portion 256 may comprise a major base end 260 and a minor base end 264. The major base end 260 may be integrally joined to the cylindrical body portion 252. Additionally, the minor base end 264 may be integrally joined to a reduced diameter cylindrical portion 252. In turn, the reduced diameter cylindrical portion 252 may be integrally joined to the base end of a substantially frustoconical point 272. The radius of the base of the frustoconical point 272 may be larger than the radius of the reduced diameter cylindrical portion 268. In this manner, the overshot coupling portion 248 may be selectively retained by overshot dogs and jaws (not shown) of an overshot assembly.

Figure 3A:
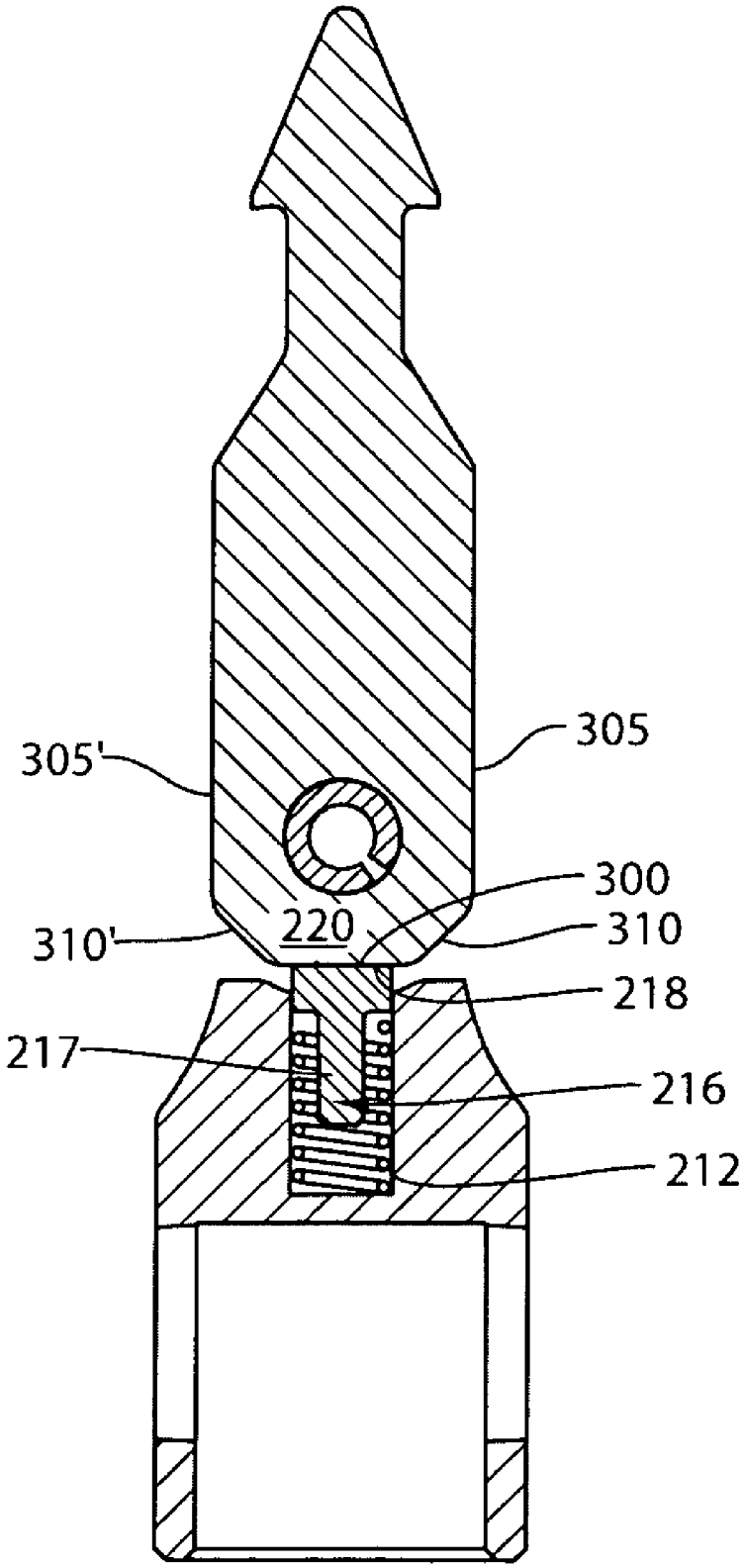
FIG. 3A illustrates a cross-sectional view of the spearhead assembly taken along section line 3A-3A of FIG. 2A.

FIG. 3A illustrates a cross-sectional view of the spearhead assembly 200 taken along section line 3A-3A of FIG. 2A. FIG. 3A illustrates the interaction of the follower tab 220 and the follower 216. As illustrated in FIG. 3A, the follower tab 220 includes a plurality of follower interfaces. The interfaces may cooperate with the follower 216 to provide the spearhead portion 204 with a plurality of detent positions, or positions that require force to be exerted on the spearhead portion 204 so as to pivot it. The spearhead portion 204 may have any number of follower interfaces. For instance, FIG. 3A shows the follower tab 220 can include a non-convex first follower interface (first follower interface) 300. In particular, a cross-sectional shape of the first follower interface 300 taken parallel to one of the exterior surfaces of the follower tab 220 can have a non-convex profile. The follower tab 220 can also include second and third follower interfaces 305, 305'.

The follower tab 220 may also contain corner interfaces. FIG. 3A shows that between the first follower interface 300 and the second follower interface 305, the follower tab 220 may include a first corner interface 310. Similarly, FIG. 3A shows that between the first follower interface 300 and third follower interface 305' the follower tab 220 may include a second corner follower interface 310'.

The follower interfaces (e.g., 300, 305, 305', 310, 310') may have any desired feature that provides the spearhead portion 204 with a plurality of detent positions. For example, follower interfaces may be any desired shape, including straight, curved, bowed, smooth, bumped, comprise recesses or protrusions, etc. In at least one example, a plane defined by the outermost points in the first follower interface is non-convex.

The corner interfaces may also have a wide variety of shapes. FIG. 3A shows that, in some examples, the corner follower interfaces 310, 310' may be curved. Nevertheless, in other embodiments, the corner follower interfaces may be substantially flat and oriented at any desired angle.

Further, as illustrated in FIG. 3A the second follower interface 305 and the third follower interface 305' may be located on the sides of the follower tab 220 and run orthogonal to other interfaces. Thus, the second follower interface 305 and the third follower interface 305' may run substantially parallel to each other. Nevertheless, in other examples, the first, second, and third follower interface 300, 305, 305' may be oriented in any other suitable manner.

Figure 3B:
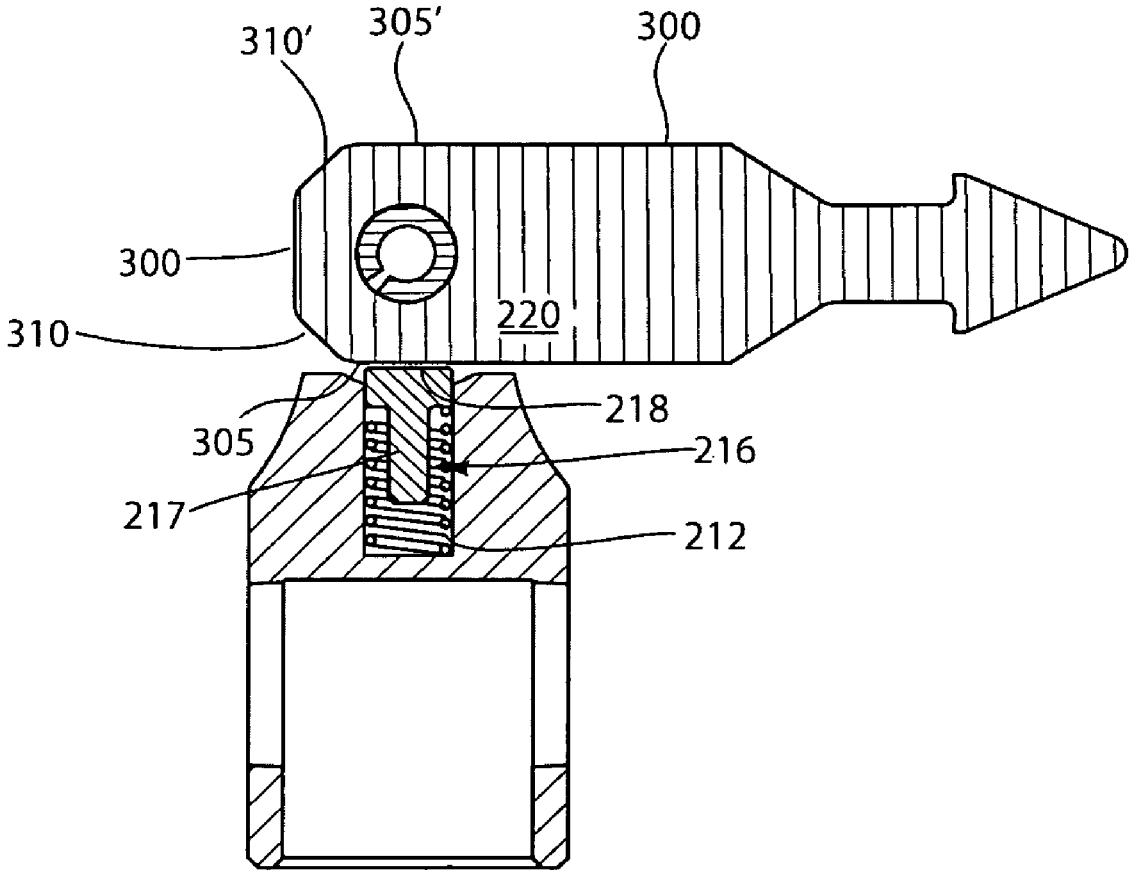
FIG. 3B illustrates a cross-sectional view of the spearhead assembly similar to the cross-sectional view of FIG. 3A, albeit with the follower tab in a rotated positioned.

The spearhead assembly can pivot in the following manner. FIG. 3B shows that, in some embodiments, the spearhead portion 204 may be pivoted about 90 degrees with respect to the 208. A pivoting load may be applied to the spearhead portion 204 by any means, such as by an inertial loading during handling of the coupled overshot and spearhead assembly 200 or by manual operator application. The width of the follower head 218, determines the moment arm through which the biasing member 212 and the follower 216 act against the rotational movement of the spearhead 204. A relatively wider follower head 218 can provide relatively greater resistance against movement of the spearhead 204 and vice versa. However, this directly affects the width of the receiving slot 232 and the support arms 228, 228' of the base component 208.

Referring again to FIG. 2A and FIG. 2B, the base component 208 can further include a cylindrical base portion 276 may have any characteristic that allows it to serve as a connection between the spearhead portion 204 and a downhole object. For example, the cylindrical base portion 276 may be any shape or size suitable for use in a drilling operation and suitable for connecting the base portion 208 to any known downhole object or tool.

The cylindrical base portion 276 can be connected to a downhole object in any suitable manner. For example, the cylindrical base portion 276 may be configured to threadingly engage a downhole tool, as is known in the art. However, in another example, the cylindrical base portion 276 may be adapted to be connected to a downhole tool, such as a conventional latch release tube (not illustrated), through the use of a pin (not shown). In this example, a portion of the base cylindrical 276 may be inserted into a latch release tube. A pin (not shown) may then be inserted through an opening on one side of the latch release tube, pass through elongated apertures 100 and 100' in the cylindrical base portion 276, and be mounted in an opening on an opposite side of the latch release tube. Thus, the cylindrical base portion 276 may be connected to the latch release tube and the elongation of the apertures 280, 280' may permit limited movement of the base portion 208 relative to the latch release tube.

In some embodiments, the cylindrical base portion 276 may also comprise a fluid communication path that allows fluid, such as drilling mud, to flow through a portion of the base portion 208. Because the fluid communication path may allow mud or other drilling fluid to pass through the spearhead assembly 200 in a substantially unimpeded manner, the communication path may allow the spearhead assembly 200 and the connected downhole object to travel at greater speeds up and down the borehole (or drill string). Additionally, the flow of drilling fluid helps maintain operating temperatures in suitable ranges, lubricating moving parts, carrying cuttings away from a drilling point, and/or driving or otherwise powering downhole equipment. Accordingly, the fluid communication path may allow the maintenance and continuation of these functions of the drilling fluid in a substantially unhindered manner.

A first end 276A can be coupled to the cylindrical base portion 276 and to the support arms 228, 228' while a portion of a second end 276B may be substantially hollow. Drilling fluid may enter the cylindrical base portion 276 through an opening in the second end 276B of the cylindrical base portion 276 and then exit through the elongated apertures 280, 280'.

Figure 4:
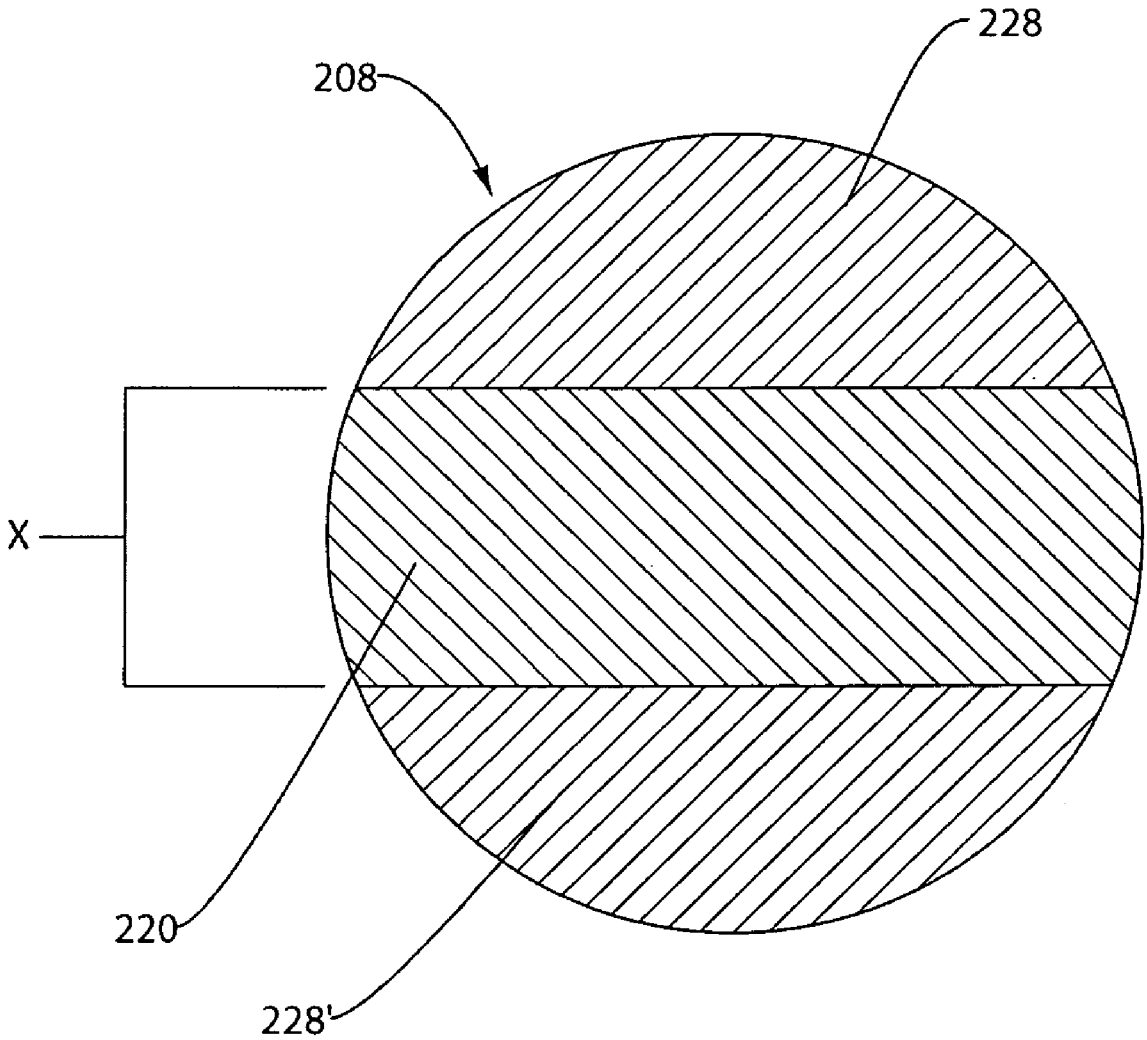
FIG. 4 illustrates a cross-sectional view of the spearhead assembly taken along section line 4-4 of FIG. 2A and contains a view of a portion of some embodiments of a jointed spearhead assembly.

For example, FIG. 4 depicts a cross-sectional view taken along section line 4-4 in FIG. 2A illustrated the configuration of the base portion 208 where the support arms 228, 228' connect to the base portion 208. As illustrated in FIG. 4, the width X of the follower tab 220 may be between about 9/10 and about 1/10 of the distance between the exterior surfaces of the support arms 245. In yet other embodiments, the width X of the follower tab 220 may be about 1/3 between the exterior surfaces of the support arms 245. The optimal selection of tab width and support arm width, with consideration for the related location of the double shear planes through the mating spring pin, determines the optimal pull strength. Recent pull tests showed current prototype strength at 175% strength as compared to the previous spearhead designs.

The components described above can have various configurations and shapes. The contact surface 218 may have any shape that allows it press against the follower interfaces 300, 305, 305' to create detent positions for the spearhead portion 204. For example, the contact surface 218 may be substantially flat, convex, concave, or combinations thereof. As shown in the embodiments depicted in FIGS. 2A and 2B, the top of the contact surface 218 may be substantially flat. The shaft 217 may have any shape, including substantially cylindrical, cuboidal, polygonal, or combinations thereof that fits within the contact surface.

The follower 216 may be made of any suitable material that resists wear and allows follower interfaces 300, 305, 305', 310, 310' to move or slide across the contact surface 218 of the follower 216. Some non-limiting examples of such materials may include any suitable type of nylon, including, but not limited to, a self-lube, wear-resistant nylon, such as NYLATRON® (which may comprise nylon and molybdenum disulfide), metals or metal allows (such as steel, iron, etc.); hard polymers; ceramics; etc. In some embodiments, it may be beneficial to form the follower 216 from a self-lube, wear resistant nylon.

A bias (via biasing member 212) may be applied to force the follower 216 and press its contact surface 218 against the follower interfaces 300, 305, 305', 310, 310', thereby providing the spearhead portion 204 with a plurality of detent positions. Any portion that may resiliently force the contact surface 218 against the interfaces may serve as the biasing member. Some non-limiting examples of a biasing member may include a pneumatic cylinder, a rubber sleeve, and a spring as shown in the Figures.

FIGS. 2A and 2B show that the biasing member 212 can include a coil spring that may be located in any position that allows it to force the contact surface 218 against the interfaces 300, 305, 305', 310, 310'. The biasing member 212 may be located within the shaft 217, outside of the shaft 217, or some combination thereof.

The biasing member 212 may be any size that fits at least partially within the recess 244 and biases the follower 216 in the desired manner. For example, where the biasing member 212 is disposed outside of the shaft 217, the biasing member 212 may have a cross-sectional diameter of between about 1/10 of an inch and about 2 inches. In another example, the cross-sectional diameter of the biasing member 212 may be between about 1/5 of an inch and about 1 inch. In still another example, the cross-sectional diameter of the biasing member 212 may be about 1/2 inch.

In addition to the aforementioned portions and features, the spearhead assembly 200 may comprise any other known portion or feature. For example, the interfaces (300, 305, 305', 310, and/or 310') on the follower tab 220 may comprise notches (not shown). In such an example, the follower 216 may also comprise one or more protrusions that correspond and mate with these notches in the follower tab 220. Such notches may serve to increase the amount of force required to pivot the spearhead portion 204 between detent positions.

As the spearhead portion 204 pivots about the pin 240 in the direction of the arrow 315, the contact surface 218 of the follower 216 may contact and slide across the third follower interface 305'. As the contact surface 218 nears the second corner interface 310', the follower 216 may be forced to move deeper into the recess 244. This pivoting continues until the contact surface 218 of the follower 216 contacts the peak of the second corner follower interface 310'. Depending on the shape of the follower tab 220 and the placement of the pin 240, the contact surface 218 may contact the peak of the second corner interface 310' when the spearhead portion 204 is pivoted about between about 35 and 272 degrees from the 0 degree position. As the peak of the corner contact surface 310' moves past the follower 216, the biasing member 212 may force the follower 216 to move closer to the pin 240. In some embodiments, the follower 216 may continue to move towards the pin 240 until the spearhead portion 204 about reaches the 0 degree position.

In some embodiments, the configuration of the biasing member 212 may be such that once the spearhead portion 204 is pivoted so the follower 216 is no longer in contact with the peak of the corner interface 310', the spearhead portion 204 (unless manually restrained) may return to the 0 degree position (as shown in FIG. 1). The spearhead portion 204 and the base portion 208 may also be substantially aligned and be resiliently retained in such a position until a sufficiently great external force is applied to spearhead portion 204 relative the base portion 208, either in or against the direction of the arrow 315.

Depending on the shape of the follower tab 220, the number of follower interfaces, the position of the pivot, etc., the spearhead assembly may have any number of detent positions. Generally, the spearhead assembly may have from any number of detent positions. In some embodiments, the spearhead portion 204 may have three or five detent positions. For example, FIG. 3 illustrates that the spearhead portion 204 may have three hard detent positions, or positions that require relatively more force to pivot the spearhead portion 204. Specifically, FIG. 3 shows the spearhead portion 204 may have a first detent position at the center-neutral position and two other detent positions at 90 degrees in either direction of the center-neutral position.

Figure 5:
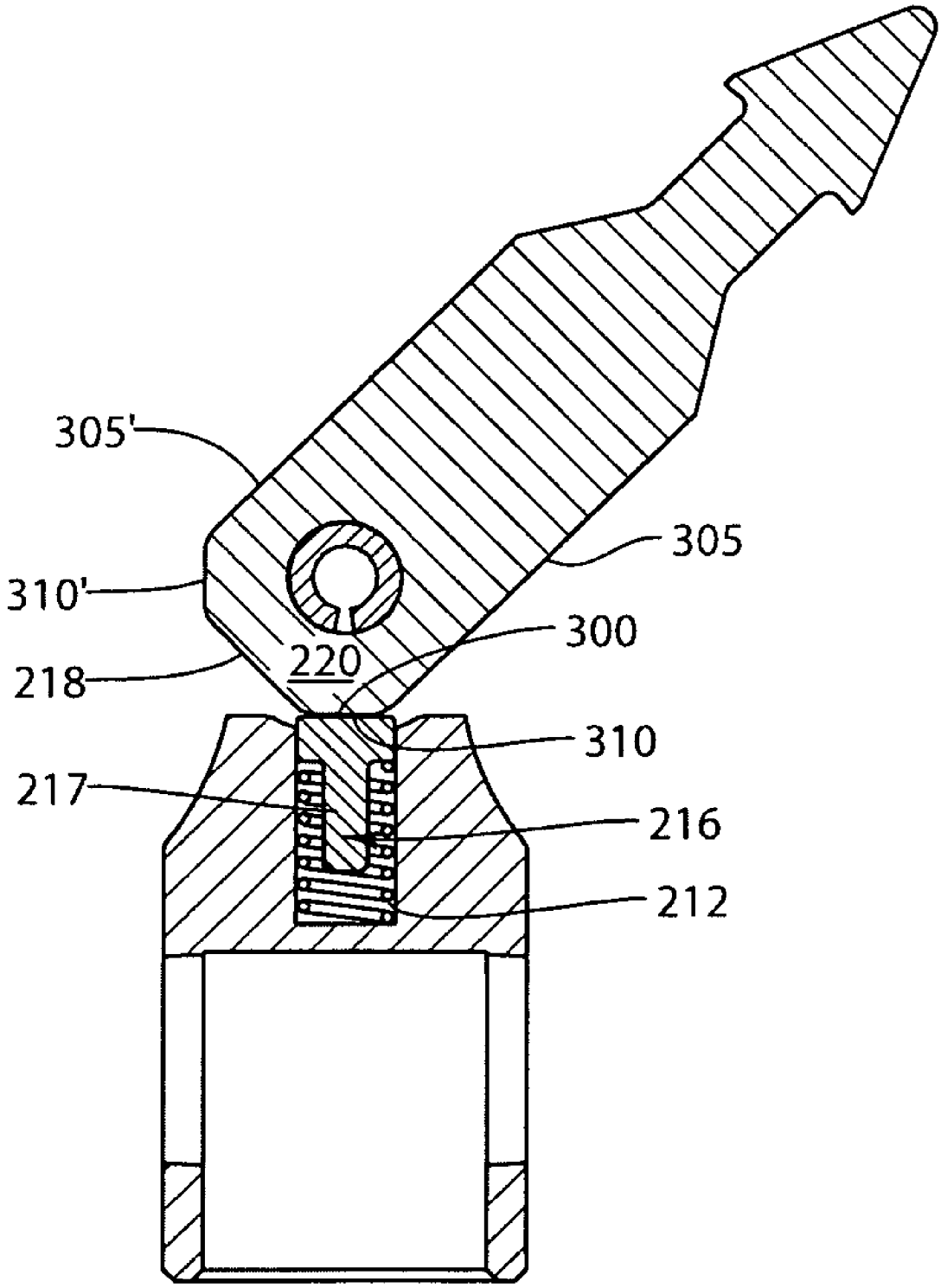
FIG. 5 illustrates a spearhead assembly in a soft-detent position according to one example.

The spearhead assembly 200 may also comprise two soft detent positions, or positions that require less force to pivot the spearhead portion 204 to another detent position. For example, FIG. 5 shows the spearhead portion 204 in a first soft detent position. Specifically, FIG. 5 shows the spearhead portion 204 may have a soft detent position where the follower 216 is in contact with a portion of the first corner interface 310. Although the spearhead assembly may be designed to create a soft detent position when the spearhead portion 204 is at any angle with respect to the base portion 208, the soft detent position may be a position where the spearhead portion 204 is pivoted between about 35 to about 272 degrees relative to the base portion. Although not illustrated, the spearhead may have a second soft detent position when the spearhead is pivoted so the follower 216 contacts the second corner interface 310'.

The spearhead assembly 200 may be used in any known manner to raise and lower objects through a drill string. For example, where a core barrel inner tube assembly located within the drill string is attached to the spearhead assembly 200, an overshot assembly may be lowered down through the drill string until the overshot contacts the frustoconical point 272 of the spearhead portion 204. At that point, the overshot dogs and jaws of the overshot assembly may capture the frustoconical point 272 so that the overshot is coupled with the spearhead assembly 200. In embodiments where the spearhead assembly 200 is connected to a latch release tube, retraction of the overshot may move the latch release tube so as to retract latches (not shown) that secure the inner tube assembly within the drill string. Once the latches are released, the overshot, inner tube assembly, and spearhead assembly 200 may be retracted up through the drill string.

A wireline hoist may then elevate the coupled assemblies so the lower end of the inner tube assembly is completely above the borehole (or a drill string). Then, the core barrel inner tube assembly may be moved so the lowermost end of the assembly is away from the borehole. At the same time, the wireline hoist may be operated to lower the overshot. As a result, the spearhead portion 204 may pivot relative to the base portion 20. As this occurs, the first follower interface 305 and a corner interface (e.g., 310') may act to cam the follower 216 into the recess 244.

In some instances, once the peak of the rounded corner interface (e.g., 310') passes the follower 216, the follower 216 may begin to move out of the recess 244 until the spearhead portion 204 is in a near 90 degree detent position as illustrated in FIG. 5. In other instances, the spearhead portion 204 may pivot until the follower 216 is in contact with the peak of the second corner interface (e.g., 310'). The spearhead portion 204 may remain in that soft detent position until sufficient force is applied to move it either direction.

Referring to FIGS. 1, 4, and 5, when the inner tube assembly has been moved to be substantially flat on a surface (e.g., the surface of the earth), the spearhead portion 204 may extend upwardly at a substantial angle (usually at about 90 degrees). Overshot dogs over the overshot assembly 190 may then be operated to release their coupling engagement with the overshot coupling portion 25. If desired, the core barrel inner tube assembly can then be disconnected from the spearhead assembly.

The spearhead assembly can also be used to place a downhole object into a borehole. The spearhead assembly is connected to an overshot assembly. The overshot assembly may then be moved and the spearhead portion 204 attached to a core barrel inner tube assembly. Once coupled, the wireline hoist may be operated to elevate the overshot assembly, which may elevate the spearhead assembly 200. This may result in the base portion 20 being elevated and pivoting in the direction opposite to that of the arrow 145 in FIG. 2. Thus, the lowermost end of the second inner tube assembly may move along the surface toward the drill string.

When the overshot assembly has been elevated sufficiently so the inner tube assembly is closely adjacent to the drill string and is out of abutting relationship with the surface of the earth, or another structure, the follower 216 and bias (e.g., spring 95) may retain the spearhead portion 204 in the near 0 degree position. The coupled assemblies may then be lowered down the drill string. Once lowered to a desired depth, the overshot dogs may release the spearhead assembly 200. The overshot and wireline may then be retracted from the drill string. As the drilling process continues, the follower 216 and the bias (e.g., biasing member 212) may continue to retain the spearhead portion 204 in the near 0 degree position. In this manner, the overshot may later be lowered and coupled with the spearhead assembly 200 to retrieve the inner tube assembly or other downhole object.

The spearhead assembly 200 described above offers several benefits over conventional jointed spearhead assemblies. First, the ability of spearhead assembly 200 to pivot may assist in shifting mechanical stresses and strains from the weakest points to areas of greater strength and durability. Second, since the biasing member may be housed within the recess 244, the safety can be increased because operators may not be pinched or otherwise injured by an exposed spring of the biasing member. Third, because the biasing member 212 may be located outside the follower 216 and within the base portion 208, as opposed to being located within the follower tab 220, the biasing member 212 may be larger and stronger than conventional springs.

Fourth, the strength of the spearhead assembly 200 at the pivot joint between the spearhead portion 204 and the base portion 208 is increased. The support arms 228, 228' may be disposed on the base portion 208 instead of on the spearhead portion 204. As well, the follower 216 may be disposed in the base portion 208 instead of in the spearhead portion 204. This configuration allows the support arms 228, 228' to have larger cross-sectional areas than some conventional jointed spearhead assemblies. Thus, the arms of the spearhead assembly 200 may be stronger than those of conventional jointed spearhead assemblies. Accordingly, the spearhead assembly 200 may be less prone to bending, deformation, undesired uncoupling, and/or failure.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A jointed spearhead assembly, comprising:

a base portion adapted to be connected to a down-hole object, the base portion comprising a recess that receives a follower and a biasing member; and a spearhead portion having a first end and a second end, the second end including a follower tab with a non-convex first follower interface, the spearhead portion being pivotally coupled to the base portion.

2. The jointed spearhead assembly of claim 1, wherein the spearhead portion is pivotally coupled to the base portion so as to have a plurality of detent positions.

3. The assembly of claim 1, wherein the follower tab is pivotally received within a slot that is defined by arms disposed on the base portion.

4. The assembly of claim 1, wherein follower tab further includes a second and a third follower interface which are disposed on lateral sides of the follower tab.

5. The assembly of claim 4, wherein the follower contacts the first, the second, and the third follower interfaces to create the detent positions.

6. The assembly of claim 1, wherein the non-convex first follower interface has a substantially planar shape.

7. A jointed spearhead assembly, comprising:

a base portion containing a recess that opens into a slot defined by a plurality of arms, wherein a follower and a bias portion are at least partially disposed within the recess; and a spearhead portion comprising an overshot connector and a follower tab, wherein the follower tab comprises a first follower interface that is substantially flat and disposed at a first end, wherein the follower tab is pivotally connected between the plurality of arms of the base portion, and wherein the follower contacts the first follower interface to provide the spearhead portion with a detent position.

8. The assembly of claim 7, wherein follower tab further includes a second and a third follower interface which are disposed on lateral sides of the follower tab.

9. The assembly of claim 8, wherein the follower contacts the first, the second, and the third follower interfaces to create multiple detent positions.

10. The assembly of claim 9, wherein the spearhead portion has at least three hard detent positions.

11. The assembly of claim 9, wherein the follower tab further comprises a first and a second corner follower interface, wherein the first corner follower interface is disposed between the first and the second follower interfaces, and wherein the second corner interface is disposed between the first and the third follower interfaces.

12. The assembly of claim 11, wherein the spearhead portion has at least two three hard detent positions.

13. The assembly of claim 11, wherein at least one of the first follower interface, the first corner interface, and the second corner interface includes a recess defined therein.

14. The assembly of claim 13, wherein each of the first follower interface, the first corner interface, and the second corner interface includes a recess defined therein.

15. A drilling system, comprising:

a jointed spearhead assembly containing:

a base portion containing a recess that opens into a slot defined by a plurality of arms, wherein a follower and a bias portion are substantially disposed within the recess; and a spearhead portion comprising an overshot connector and a follower tab, wherein the follower tab comprises a first follower interface that is substantially flat and disposed at a first end, wherein the follower tab is pivotally connected between the plurality of arms of the base portion, and wherein the follower contacts the first follower interface to provide the spearhead portion with a detent position; and a downhole object connected to the base portion.

16. The system of claim 15, wherein follower tab further includes a second and a third follower interface which are disposed on lateral sides of the follower tab.

17. The system of claim 16, wherein the spearhead portion has at least three hard detent positions.

18. The system of claim 15, wherein the follower contacts the first, the second, and the third follower interfaces to create multiple detent positions.

19. The system of claim 18, wherein the spearhead portion has at least two three hard detent positions.

20. The system of claim 15, wherein the follower tab further comprises a first and a second corner follower interface, wherein the first corner follower interface is disposed between the first and the second follower interfaces, and wherein the second corner interface is disposed between the first and the third follower interfaces.

21. A method for drilling, comprising providing a jointed spearhead assembly containing a base portion containing a recess that opens into a slot defined by a plurality of arms, wherein a follower and a bias portion are substantially disposed within the recess, and a spearhead portion comprising an overshot connector and a follower tab, wherein the follower tab comprises a first follower interface that is substantially flat;

pivotally connecting the follower tab of the spearhead portion between the plurality of arms of the base portion so that the follower contacts the first follower interface to provide the spearhead portion with a detent position;

coupling the spearhead assembly to an overshot assembly; and raising or lowering the coupled spearhead assembly and overshot assembly in a borehole.

22. The method of claim 21, wherein follower tab further includes a second and a third follower interface which are disposed on lateral sides of the follower tab.

23. The method of claim 22, wherein the follower contacts the first, the second, and the third follower interfaces to create multiple detent positions.

24. The method of claim 23, wherein the spearhead portion has at least three hard detent positions.

25. The method of claim 22, wherein the follower tab further comprises a first and a second corner follower interface, wherein the first corner follower interface is disposed between the first and the second follower interfaces, and wherein the second corner interface is disposed between the first and the third follower interfaces.

26. The method of claim 25, wherein the spearhead portion has at least three hard detent positions.

27. The method of claim 21, further comprising connecting the base portion to a downhole object.

* * * * *

UNITED STATES PATENT AND TRADEMARK OFFICE

CERTIFICATE OF CORRECTION

PATENT NO. : 7,921,926 B2
APPLICATION NO. : 12/349431
DATED : April 12, 2011
INVENTOR(S) : Drenth et al.

It is certified that error appears in the above-identified patent and that said Letters Patent is hereby corrected as shown below:

Column 1
Line 8, change "incorporated-by" to --incorporated by--

Column 2
Line 43, change "positioned" to --position--

Column 4
Line 13, change "down-component" to --down-hole component--

Column 5
Line 44, change "base portion 212" to --base portion 208--

Column 7
Line 6, before "208" insert --base portion--
Line 19, after "base portion 276" insert --that--
Line 33, remove [base]
Line 34, after "cylindrical" insert --base portion--

Column 8
Line 5, change "support arms 245" to --support arms 228--
Line 7, change "support arms 245" to --support arms 228--
Line 16, change "allows it press" to --allows it to press--
Line 32, change "allows" to --alloys--

Column 9
Line 35, change "have from any" to --have any--

Signed and Sealed this
Sixteenth Day of August, 2011

David J. Kappos

David J. Kappos
*Director of the United States Patent and Trademark Office*

Column 10
Line 17, change "base portion 20" to --base portion 208--
Line 35, change "overshot coupling portion 25" to --overshot coupling portion 248--
Line 45, change "base portion 20" to --base portion 208--
Line 53, change "spring 95" to --spring 212--

Column 12
Line 17, change "least two three hard" to --least three hard--
Line 49, change "least two three hard" to --least three hard--